US006607789B1

(12) United States Patent
Rigney et al.

(10) Patent No.: US 6,607,789 B1
(45) Date of Patent: Aug. 19, 2003

(54) PLASMA SPRAYED THERMAL BOND COAT SYSTEM

(75) Inventors: Joseph David Rigney, Milford, OH (US); Michael James Weimer, Loveland, OH (US); Bangalore Aswatha Nagaraj, West Chester, OH (US); Yuk-Chiu Lau, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 22 days.

(21) Appl. No.: 09/842,503

(22) Filed: Apr. 26, 2001

(51) Int. Cl.[7] ..... C23C 4/04; B05D 1/36

(52) U.S. Cl. ..... 427/454; 427/456; 427/405; 427/419.2; 427/419.7

(58) Field of Search ..... 427/454, 456, 427/405, 419.2, 419.7

(56) References Cited

U.S. PATENT DOCUMENTS

| | | | | |
|---|---|---|---|---|
| 2,712,498 A | | 7/1955 | Gresham et al. | 75/171 |
| 3,754,903 A | | 8/1973 | Goward et al. | 75/171 |
| 3,890,456 A | | 6/1975 | Dils | 428/216 |
| 3,928,026 A | | 12/1975 | Iecht et al. | 75/134 F |
| 4,095,003 A | | 6/1978 | Weatherly et al. | 427/34 |
| 5,236,745 A | | 8/1993 | Gupta et al. | 427/454 |
| 5,482,578 A | | 1/1996 | Rose et al. | 148/516 |
| 5,817,371 A | | 10/1998 | Gupta et al. | 427/454 |
| 5,817,372 A | | 10/1998 | Zheng | 427/456 |
| 5,972,424 A | | 10/1999 | Draghi et al. | 427/142 |
| 5,975,852 A | | 11/1999 | Nagaraj et al. | 416/241 R |
| 5,981,088 A | | 11/1999 | Bruce et al. | 428/633 |
| 6,020,075 A | * | 2/2000 | Gupta et al. | 428/612 |
| 6,074,706 A | | 6/2000 | Beverley et al. | 427/454 |
| 6,096,381 A | | 8/2000 | Zheng | 427/454 |
| 6,153,313 A | * | 11/2000 | Rigney et al. | 416/241 B |
| 6,165,628 A | * | 12/2000 | Borom et al. | 428/612 |
| 6,190,124 B1 | * | 2/2001 | Freling et al. | 415/173.4 |

FOREIGN PATENT DOCUMENTS

EP 985 745 A1 * 3/2000

OTHER PUBLICATIONS

Metals Handbook, Ninth Edition, vol. 5, Surface Cleaning, Finishing, and Coating, American Society For Metals, 1982, p. 363.*

* cited by examiner

*Primary Examiner*—Katherine A. Bareford
(74) *Attorney, Agent, or Firm*—Carmen Santa Maria; McNees Wallace & Nurick LLC

(57) ABSTRACT

A method for forming a thermal barrier coating system on an article subjected to a hostile thermal environment, such as the hot gas path components of a gas turbine engine. The coating system is generally comprised of a ceramic layer and an environmentally resistant beta phase nickel aluminum intermetallic (β-NiAl) bond coat that adheres the ceramic layer to the component surface. A thin aluminum oxide scale forms on the surface of the β-NiAl during heat treatment. The β-NiAl may contain alloying elements in addition to nickel and aluminum in order to increase the environmental resistance of the β-NiAl. The β-NiAl powder having a size in the range of 20–50 microns is applied using air plasma spray techniques to produce a surface having a roughness of 400 microinches or rougher. The ceramic top coat can be applied using inexpensive thermal spray techniques to greater thicknesses than achievable otherwise because of the rough surface finish of the underlying β-NiAl bond coat.

6 Claims, 1 Drawing Sheet

PLASMA SPRAYED THERMAL BOND COAT SYSTEM

FIELD OF THE INVENTION

The present invention relates to protective coatings for components exposed to high temperatures, such as components of a gas turbine engine. More particularly, this invention is directed to a process for forming a thermal barrier coating system utilizing a NiAl bond coat and a ceramic top coat using an air plasma spray method.

BACKGROUND OF THE INVENTION

Higher operating temperatures for gas turbine engines are continuously sought in order to increase their efficiency. However, as operating temperatures increase, the high temperature durability of the components of the engine must correspondingly increase. Significant advances in high temperature capabilities have been achieved through formulation of nickel and cobalt-base superalloys, though such alloys alone are often inadequate to form components located in certain sections of a gas turbine engine, such as the turbine, combustor and augmentor. A common solution is to thermally insulate such components from the hot gases of combustion in order to minimize their service temperatures and to provide environmental protection to prevent deterioration from these hot, corrosive, oxidative gases. For this purpose, thermal barrier coating (TBC) systems formed on the exposed surfaces of high temperature components have found widespread use.

To be effective, thermal barrier coating systems must have low thermal conductivity, strongly adhere to the article, and remain adherent through many heating and cooling cycles. They also must protect the underlying substrate from environmental damage. Adherence to a substrate is a technical challenge due to the different coefficients of thermal expansion between materials having low thermal conductivity such as the ceramic materials typically used for thermal barrier coatings, and superalloy materials typically used to form turbine engine components. Thermal barrier coating systems capable of satisfying the above have generally required a metallic bond coat deposited on the component surface to provide an intermediate layer that may have a coefficient of thermal expansion that lies between that of the substrate material and the ceramic materials used for thermal barriers, but primarily is formulated to provide environmental protection from the hot oxidative and corrosive gases of combustion found in the turbine environment. Such coatings produce an adherent thermally grown oxide (TGO) layer that aids in the adherence of the TBC deposited on top of it.

Various ceramic materials have been employed as the ceramic layer, particularly zirconia ($ZrO_2$) stabilized by yttria ($Y_2O_3$), magnesia (MgO), ceria ($CeO_2$), scandia ($Sc_2O_3$), or other oxides. These particular materials are widely employed in the art because they can be readily deposited by plasma spray, flame spray and physical vapor deposition techniques. In order to increase the resistance of the ceramic layer to spallation when subjected to thermal cycling, thermal barrier coating systems employed in higher temperature regions of a gas turbine engine are typically deposited by physical vapor deposition (PVD) techniques, particularly electron beam vapor deposition (EB-PVD), that yield a spall-resistant columnar grain structure in the ceramic layer that is considered to be strain tolerant. PVD processes are preferred for deposition of ceramic layers at these hot surface locations because of the need for smooth thickness transitions, cooling hole communication between internal cooling fluid supplies and external surfaces. Air plasma sprayed (APS) are used in regions not having a large number of cooling holes open to the surface, but requiring thermal protection using thicker coatings than can efficiently and economically be applied using PVD. APS ceramic coatings typically require bond coats with surface roughnesses sufficient to enhance the mechanical bond between the two layers.

The bond coat typically is formed from an oxidation resistant aluminum-containing alloy to promote adhesion of the ceramic layer to the component through the formation of a TGO at the interface. The bond coat is critical to promoting the spallation resistance of a thermal barrier coating system. Examples of prior art bond coatings include MCrAlY (where M is iron, cobalt, and/or nickel), diffusion coatings such as nickel aluminide or platinum aluminide bond coats, and beta-phase NiAl, which are oxidation-resistant aluminum based intermetallics. The MCrAlY bond coats typically are deposited by air plasma spray (APS), while beta-phase NiAl is typically deposited by low pressure plasma spray (LPPS) techniques or high velocity oxyfuel (HVOF) techniques. The LPPS bond coats are smooth and grow a smooth, strongly adherent and continuous TGO layer that chemically bonds the ceramic layer to the bond coat, and protects the bond coat and the underlying substrate from oxidation and hot corrosion.

Bond coat materials are particularly alloyed to be oxidation and corrosion resistant through the formation of the thin, adherent alumina scale which may be further doped with chromia or other reactive oxides or elements. However, when used solely as an environmental coating, that is, without a ceramic topcoat, the thin alumina or chromia-doped alumina scale is adversely affected by the hot, corrosive environment, but quickly reforms. However, the reforming of a replacement scale gradually depletes aluminum from the environmental coating. When used as an environmental coating or bond coat for TBC applications, aluminum is lost from the bond coat as a result of interdiffusion into the superalloy substrate. Eventually, the level of aluminum within the bond coat is sufficiently depleted to prevent further growth of the protective alumina scale and/or stresses in the TGO have risen significantly, at which time spallation may occur at the interface between the bond coat and the ceramic layer.

In addition to the depletion of aluminum, the ability of the bond coat to form the desired alumina scale on the bond coat surface can be hampered by the diffusion of elements from the superalloy into the bond coat, such as during formation of a diffusion aluminide coating or during high temperature exposure. Oxidation of such elements within the bond coat can become thermodynamically favored as the aluminum within the bond coat is depleted through oxidation and interdiffusion. High levels of elements such as nickel, chromium, titanium, tantalum, tungsten and molybdenum incorporated into the TGO can increase the growth rate of oxide scales and form non-adherent scales on the bond coat surface that may be deleterious to adhesion of the ceramic layer. One of the ways in which such problems have been addressed is the addition of a monolithic beta-phase NiAl layer to the surface of a superalloy component using methods such as LPPS, e.g., U.S. Pat. No. 5,975,852 Nagaraj et al., with an oxide layer formed directly on top of the β-NiAl substrate. LPPS using relatively fine powders produces a relatively smooth surface, and after application of the β-NiAl layer, the coated surface is treated to have a surface finish not greater than about 50 microinches (about 1.2 micrometer) $R_a$, such as by electropolishing, vapor honing, polishing or light abrasive blasting. Such layers are required to be thick in order to exhibit an enhanced service life for the component. A ceramic topcoat having columnar grains is then applied by a physical vapor deposition (PVD) process. Frequently, however, the bond coat is intentionally sprayed to provide a rough surface finish to enable the formation of a better mechanical bond between the bond coat and an APS ceramic topcoat.

In contrast to LPPS, because APS bond coats that include aluminum are deposited at an elevated temperature in the presence of air, they inherently form entrapped oxides and the scale that forms during disclosure may not be smooth and continuous. As a result, thermal barrier coating systems employing APS bond coats have not had the high temperature (e.g. above 1000° C.) oxidation resistance of systems employing LPPS bond coats. Furthermore, adhesion of a thermal sprayed ceramic layer to a non-beta-phase NiAl APS bond requires a surface roughness of about 200 microinches to about 500 microinches Ra on the bond coat, and the APS ceramic top coat is bonded to the bond coat by a substantially mechanical bond.

APS bond coats are often favored due to the higher as-sprayed surface roughness, lower equipment cost and ease of application and masking. As a result, various approaches have been proposed to improve the oxidation resistance of APS bond coats, including overcoat aluminiding by which aluminum is diffused into the surface of the bond coat by pack cementation or non-contact vapor (gas phase) techniques. However, results tend to be inconsistent and the added steps increase production costs. In addition, while various overlay coatings have been proposed to further enhance the oxidation resistance of diffusion aluminide and LPPS bond coats, e.g. U.S. Pat. No. 5,427,866 Nagaraj et al., such techniques have utilized a low pressure plasma so that a strain-tolerant PVD ceramic top coat can be adhered to the bond coat.

APS bond costs have been used to deposit the coating at elevated temperatures, however, prior art indicates that such high temperatures necessarily mean that more oxides are formed during the APS process. The APS application promotes a rough surface finish and prevents the formation of an adhesion-promoting smooth continuous oxide scale that is required of the application of a sound TBC by a PVD process.

Accordingly, what is needed is a process that would provides turbine components with greater performance and at a lower cost than prior coating processes, by virtue of a thinner bond coating than is currently employed by air-plasma sprayed MCrAlY and low pressure plasma sprayed NiAl bond coatings without adversely affecting the environmental resistance or spallation resistance of the thermal barrier system. Such a process should improve component durability and increase the service life of a thermal barrier coating system.

SUMMARY OF THE INVENTION

The present invention generally provides a method of forming a thermal barrier coating system on an article subjected to a hostile thermal environment, such as the hot gas path components of a gas turbine engine. The coating system is generally comprised of a ceramic layer and an environmentally resistant beta phase nickel aluminum intermetallic (β-NiAl) bond coat that adheres the ceramic layer to the component surface. A thin aluminum oxide scale forms on the surface of the β-NiAl during heat treatment.

In an alternate embodiment of the present invention, an additional layer of diffusion aluminide can be formed on the surface of the article prior to the deposition of the β-NiAl bond coat, or the diffusion aluminide can be formed immediately after the deposition of the β-NiAl bond coat, or both such that the diffusion aluminide adheres the ceramic layer to the component surface. The β-NiAl bond coat may be deposited by a combination of techniques to satisfy performance requirements. For example, HVOF employing relatively fine powders may be used to produce a first sublayer adjacent to the substrate that are dense, while APS employing relatively coarse powders may be used to produce rough, outer surface layer that may be beneficial in adhesion of the subsequently applied TBC. The HVOF process produces a smooth and dense sublayer as the HVOF technique melts the fine powders without oxidizing them. The sublayer has a surface finish of 125 $R_a$ produced with powders finer than 50 microns. The size of a powder in microns, as used herein, refers to the diameter of the powder.

According to this invention the β-NiAl may contain alloying elements in addition to nickel and aluminum in order to increase the environmental resistance of the β-NiAl. These elements include chromium and reactive elements such as hafnium, yttrium and zirconium and increase the oxidation resistance of the β-NiAl during the application using APS. An element from the Lanthanide series may also be included in the β-NiAl alloy. Besides chromium, other oxygen-gettering elements that may be included in the β-phase NiAl alloy are Ta, Nb, Ti and W. Cobalt may also be included substitutionally for a portion of the nickel. The β-NiAl has a nominal composition of about 15–33% by weight aluminum and the balance Ni, Co and combinations thereof, and incidental impurities. For the purposes of this disclosure, the term "incidental impurities" is meant to include small amounts of impurities and incidental elements, which in character and/or amount do not adversely affect the advantageous aspects of the composition. The chromium content of the β-NiAl can vary from 0 to about 20 weight percent and the zirconium content of the β-NiAl can vary from about 0.1 to about 2.4 weight percent, and the hafnium content of the β-NiAl can include about 0.1 to about 1.7 weight percent. The zirconium and hafnium improve the adhesion of the interfacial oxide layer, also referred to as TGO, thereby extending TBC life.

According to this invention, at least a portion of the beta phase nickel aluminum bond coat is deposited using an air plasma spray (APS) process. The thickness of the β-NiAl layer is in a range of about 1 to about 20 mils. If the β-NiAl layer is thinner than about 1 mils, then the amount of aluminum available from the β-NiAl layer may be insufficient to protect the surface of the article from environmental damage for the expected life of the article. The β-NiAl powder of the appropriate composition is formed in the normal manner by gas atomization. The powder is then heated above 2500° F. and applied in a semi-molten state to the article substrate using an air plasma technique. The β-NiAl powder used for the APS are preferably in the range of 20–80 microns. After application, the bond coat may be heat treated for about one to about four hours at a temperature range of 1800° F.–2100° F. in order to form a stronger metallurgical bond between the substrate, typically a nickel-based superalloy, and the β-NiAl coating. If a diffusion aluminide is applied, the heat treatment for the diffusion aluminide can be performed at the same time as the heat treatment for the β-NiAl.

The advantage to using APS rather than LPPS to deposit the beta-phase NiAl is that APS does not expose the underlying substrate to extremely high temperatures. The high temperatures necessary for the LPPS make it extremely difficult, if not impossible, for a number of engine components to be coated using the LPPS technology. In addition, APS is an inherently less expensive way to apply bond coats than LPPS. The LPPS process steps consume substantial amounts of time, thereby reducing productivity; for each chamber load, a vacuum must be established and then the chamber is refilled with a partial pressure of inert gas, after which the spray coating is conducted, followed by cool down in vacuum and unloading. Using APS, the engine parts can be coated in a ring formation allowing for a greater number of parts to be treated at any one time. Prior art clearly indicates the use of coating materials such as MCrAlY suggests high levels of oxidation upon exposure to air and prior to application that would indicate β-NiAl is uniquely suited to the thermal and environmental conditions that coating materials encounter when applied by APS.

In the prior art, one of the limitations ascribed to APS is the high temperature at which the molten nickel aluminum coating particles enter the atmosphere prior to deposition on the substrate. These high temperatures further suggest that the use of APS generally means that oxidation will occur during the spraying process that will cause greater spallation during the life of the coated part. However, a true stoichiometric β-NiAl requires a temperature of about 2980° F. (1638° C.) in order to liquefy, normally a temperature that causes a severe oxidation in other alloys. However, in practice, β-NiAl has evidenced very low levels of oxidation as compared to bond coatings such as MCrAlY.

In addition to the aforementioned advantages of the APS over the LPPS, the present invention also enables the use of a thinner coat of β-NiAl that could be achieved with the LPPS technology. For example, U.S. Pat. No. 5,975,852 discloses that the minimum thickness of NiAl required to be applied such as by LPPS is 125 microns (about 0.005"). The thinner coat that can be applied by the present invention allows the treatment of larger pieces of equipment that includes cooling apertures. Such apertures would be completely covered by the LPPS technology are not covered using the APS method.

The surface roughness created by the APS method also allows the ceramic coating to be applied using a lower cost thermal spray technology, such as APS. In order to apply the ceramic topcoat using APS techniques and achieve an adherent ceramic top coat, the β-NiAl bond coat should have a surface roughness ($R_a$) of 400 microinches or in excess of 400 microinches, that is the surface finish is no smoother than about 400 microinches. The larger particles coupled with the well known air plasma spray parameters make such a relatively rough surface possible. Another advantage of applying a ceramic coating using APS technology over the β-NiAl bond coat is that a thicker ceramic bond coat can be applied quickly and in a cost-effective manner.

Such a surface roughness is necessary to form a good mechanical bond between the β-NiAl and the ceramic topcoat. If a good mechanical bond is not formed, spallation will occur more readily during use of the engine component. Optionally, a diffusion aluminide such as a platinum aluminide layer may be applied using vapor deposition techniques either directly onto the substrate prior to deposition of the β-NiAl or to the β-NiAl bond coat prior to deposition of the ceramic thermal barrier layer. The application of a diffusion aluminide to the substrate is in the fashion to one well known in the art. One of the benefits for placing the diffusion aluminide layer underneath the β-NiAl is that application of such a layer facilitates stripping of the remaining thermal barrier bond coat system from the part once normal wear leads to excessive spalling.

Optionally, a diffusion aluminide such as a platinum aluminide layer may be applied over the β-NiAl layer. In order to create a consistent diffusion aluminide coat on top of the beta-phase NiAl, a flash layer of either platinum, nickel or both, must be deposited directly onto the beta-phase NiAl layer. Since the beta-phase NiAl layer is a stable, aluminum-rich intermetallic, the formation of a uniform diffusion aluminide layer over the β-NiAl layer preferably requires the use of both a nickel and an platinum flash layer applied by electroplating. These flash layers are extremely thin, being less than 0.8 mil and typically 0.2 mil. If both flash layers are applied, the platinum should be deposited first in order to achieve the proper composition of the diffusion layer. Additional diffusion aluminide layers may then be deposited as desired. The β-NiAl also functions as a diffusion barrier between the substrate and any metallic layers applied over the β-NiAl layer, with the diffusion in the layer above the beta-phase NiAl limited primarily to the applied diffusion aluminide layers.

Optionally, a diffusion aluminide layer can be applied as set forth above both on top of and under the β-NiAl layer. Such a process would allow the coated part to be stripped easily while preserving the advantages of having a diffusion aluminide located over top of the β-NiAl layer to serve as the initial reservoir of aluminum for formation of a protective alumina scale.

The final step in the TBC system is the application by plasma spray of the ceramic topcoat on the surface of the β-NiAl, or optionally, on the surface of the diffusion aluminide layer. The topcoat consists of ceramic materials generally known to one familiar with the art, such as yttria stabilized zirconia, yttria non-stabilized zirconia, zirconia stabilized by ceria ($CeO_2$) or scandia ($Sc_2O_3$). The ceramic topcoat is zirconia stabilized with about 3 to about 20 weight percent yttria.

An advantage of the present invention is that a β-NiAl can be applied using an air plasma spray technique as an environmental bond coat over a nickel-based superalloy substrate. The deposited bond coat can effectively be applied as a thinner layer than with LPPS.

Another advantage of the present invention is that β-NiAl can be applied at less cost and faster than other methods of applying the β-NiAl and with the formation of an effective, protective alumina scale.

Still another advantage of the present invention is that the β-NiAl scale formed by air plasma spray provides a rough surface finish. While the rough surface finish is not suitable for application of a ceramic top coat by a PVD method, it is suitable in the as-sprayed condition without the need for further surface treatment for application of the ceramic top coat by a thermal spray technique such as an air plasma spray technique or equivalent thermal spray technique.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

The present invention will now be described, by way of example, with reference to the accompanying drawings, in which.

DETAILED DESCRIPTION OF THE PREFERRED EMBODIMENTS

Figure 1:
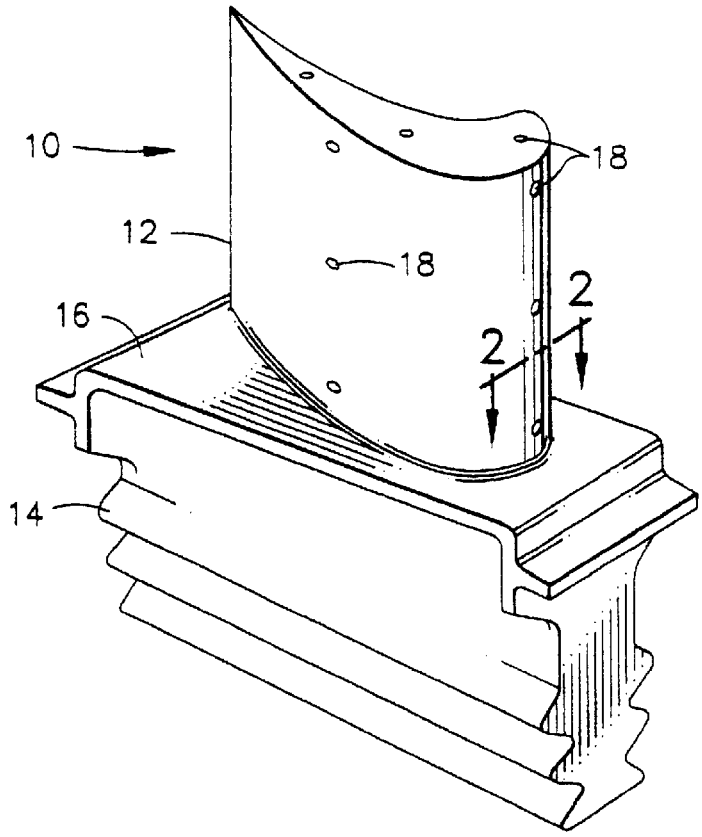
FIG. 1 is a perspective view of a high pressure turbine blade.

The present invention is generally applicable to components that operate within environments characterized by relatively high temperatures, and are therefore subjected to severe thermal stresses and thermal cycling. Notable examples of such components include the high and low pressure turbine nozzles and blades, shrouds, combustor liners, splash plates, and augmentor hardware of gas turbine engines. Typically, these articles are manufactured having cooling holes that are connected to a source of cooling fluid, so that during operation, these components can be exposed to operating temperatures that at which they would otherwise not be usable. When combined with other techniques to protect against the high temperatures of turbine operation, these components can sometimes be operated near or even above their melting temperatures. The turbine portion of the engine includes of a plurality of high pressure turbine blades such as the high pressure turbine blade 10 shown in FIG. 1. The engine is driven as a fluid strikes the blade causing the blade to turn, which in turn causes the rotor to which it is attached to turn. The blade 10 generally includes an airfoil portion 12 against which the fluid is directed. The fluid is the hot gases of combustion resulting from the combustion of fuel from the combustion portion of the engine. The airfoil thus is subject to attack by oxidation, corrosion and erosion as the hot gases of combustion strike the airfoil. The airfoil 12 is anchored to a turbine disk (not shown) with a dovetail 14 formed on a root section 16 of the blade 10. The disk in turn is attached to a turbine shaft. Cooling passages 18 are present in the airfoil 12 through which bleed air from the compressor portion of the engine is forced to cool the blade by transfer of heat from the blade 10. A thermal barrier coating system is also applied to at least the airfoil portion of the blade to further protect the airfoil substrate from the effects of the hot gases of combustion. While the advantages of this invention will be described with reference to the high-pressure turbine blade 10 shown in FIG. 1, the teachings of this invention are generally applicable to any component on which an environmental or thermal barrier coating system may be used to protect the component from its environment.

Figure 2:
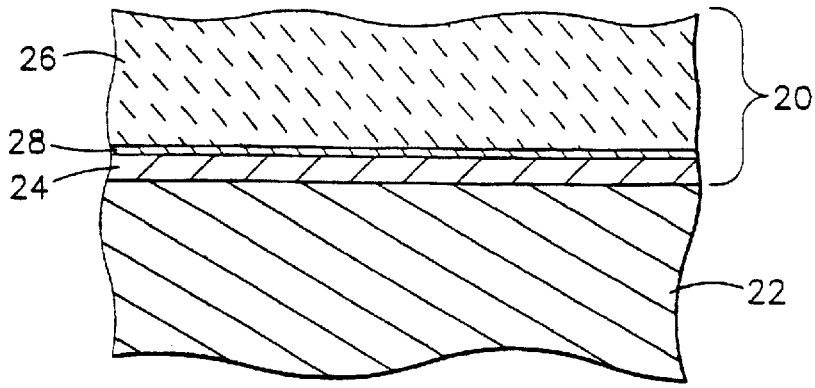
FIG. 2 is a cross-sectional view of the blade of FIG. 1 along line 2—2, and shows a thermal barrier coating on the blade in accordance with this invention.

Represented in FIG. 2 is a thermal barrier coating system 20 in accordance with this invention. As shown, the coating system 20 includes a ceramic layer 26 bonded to a β-NiAl layer, consisting essentially of nickel and aluminum in stoichiometric amounts, 24 bonded to a substrate 22 with a thin scale of alumina 28 on the β-NiAl. In a preferred composition, the β-NiAl includes 0 to about 20 percent by weight chromium and about 0.1. to about 3 weight percent zirconium. In a more preferable composition, the β-NiAl includes about 2 to about 14 weight percent chromium and about 0.5 to about 2.4 weight percent zirconium. The most preferred composition of the β-NiAl includes about 12 weight percent chromium and about 1 weight percent zirconium. According to the invention, the substrate is a high temperature material such as a superalloy that is based on Ni, Fe Co or combinations thereof. A novel feature of this invention is that the APS system is more amenable to masking and can be easily adapted to perform patch repair operations on a field-returned part. The β-NiAl bond coat layer 24 can be formed using air plasma spray (APS) rather than by the LPPS deposition process taught in the prior art. The preferable range of thickness of the β-NiAl bond coat layer is about 0.002" to about 0.007". A minimum thickness for the β-NiAl layer 24 is about 1 mil (0.001"). At thicknesses of below about 1 mil the amount of β-NiAl is insufficient to provide the necessary reservoir for the formation of a protective alumina scale for the life of the component. At thicknesses of greater than about 7 mils (0.007"), the brittle β-NiAl layer becomes more likely to chip than thinner layers of β-NiAl, making layers of β-NiAl in the range of 0.002"–0.007" preferable. Furthermore, the thicker layers of β-NiAl increase the weight of the airfoil component and decrease its aerodynamic efficiency, adversely affecting engine performance. The β-NiAl used as the bond coat 24 is not prone to interactions and interdiffusion with other elements observed with prior art bond coats and their superalloy substrates. This is due to the ordered structure of the intermetallic, which inherently allows it to act as a diffusion barrier.

During the APS deposition process and subsequent heat treatment, a thin aluminum oxide layer is formed over the β-NiAl layer. An optional diffusion aluminide layer, containing platinum or nickel, the composition of which is well known in the art, can be deposited between the β-NiAl bond coat 24 and the ceramic layer 26. Alternatively, the optional diffusion aluminide layer can be deposited between the substrate 22 and the β-NiAl bond coat 24.

The ceramic layer 26 is preferably deposited by plasma spray techniques using techniques known in the art. A preferred material for the ceramic layer 26 is zirconia containing yttria-stabilized zirconia (YSZ), having about 3 to about 20 weight percent yttria, preferably 6–8% by weight yttria, and most preferably about 7 weight percent yttria, although other ceramic materials could be used, such as non-stabilized zirconia, or zirconia stabilized by another transition oxide such as ceria ($CeO_2$) or scandia ($Sc_2O_3$). The ceramic layer 26 is deposited to a thickness that is sufficient to provide the required thermal protection for the underlying substrate 22 and blade 10, generally on the order of about 0.004"–0.030", and preferably about 0.005"–0.015".

As with prior art bond coats, the surface of the β-NiAl bond coat 24 oxidizes at elevated temperatures to form a thin alumina scale 28 to which the ceramic layer 26 bonds. The β-NiAl bond coat 24 provides a reservoir from which the oxide layer 28 is formed, and which will contribute to the reformation of the alumina scale if the scale is adversely affected as the result of interaction with the corrosive gaseous products of combustion that may penetrate the ceramic layer.

In an optional embodiment, the diffusion aluminide coating can be applied over the β-NiAl bond coat. This can provide a reservoir of aluminum from which the oxide scale is formed. Such a diffusion aluminide can be applied by depositing a thin layer of platinum, Pt, or Ni, or both over the β-NiAl coating. The layer can be deposited by physical vapor deposition, electrodeposition, sputtering, cathodic arc deposition, laser evaporation or any other known method of producing a uniform thin layer. Then, the article that includes a deposited layer can be exposed to a vapor phase aluminiding process, as is well known in the art, so that a diffusion aluminide layer is formed. The intermetallic β-NiAl bond coat that lies between the diffusion aluminide layer and the substrate acts as a diffusion barrier that significantly reduces or prevents the diffusion of elements from the substrate into the diffusion aluminide layer. The diffusion aluminide layer can be applied over the β-NiAl coating by other established techniques.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A process for forming a thermal barrier coating system on a surface of a superalloy component, the process comprising the steps of:

forming a β-NiAl bond coat over the superalloy by first applying a sublayer of dense β-NiAl material having a smooth surface finish of 125 micro inches $R_a$ and smoother, then applying an outer layer of less dense β-NiAl material having a rough surface finish of no smoother than about 400 micro inches $R_a$ over the β-NiAl sublayer, the β-NiAl bond coat having an overall thickness of at least one mil; then thermally spraying a ceramic topcoat over the β-NiAl bond coat.

2. The process of claim 1 wherein the sublayer of β-NiAl is applied using an HVOF process.

3. The process of claim 2 wherein the β-NiAl sublayer is applied using a powder size sufficiently small to produce a surface finish of 125 micro inches $R_a$ and smoother.

4. The process of claim 2 wherein the β-NiAl sublayer is applied using a powder size of less than 50 microns.

5. The process of claim 1 wherein the outer layer of β-NiAl is applied using an air plasma spray process.

6. The process of claim 5 wherein the outer layer of β-NiAl is applied using a powder size of from about 20–80 microns.

* * * * *